US007811217B2

(12) United States Patent
Odien

(10) Patent No.: US 7,811,217 B2
(45) Date of Patent: Oct. 12, 2010

(54) MOTORIZED APPARATUS AND METHOD FOR DYNAMIC BALANCING EXERCISE

(76) Inventor: Larry Richard Odien, 22023 Jodi Pl., Saugus, CA (US) 91350

( * ) Notice: Subject to any disclaimer, the term of this patent is extended or adjusted under 35 U.S.C. 154(b) by 27 days.

(21) Appl. No.: 12/157,023

(22) Filed: Jun. 6, 2008

(65) Prior Publication Data

US 2008/0242515 A1 Oct. 2, 2008

Related U.S. Application Data

(63) Continuation-in-part of application No. 11/796,608, filed on Apr. 26, 2007, now abandoned.

(60) Provisional application No. 60/795,516, filed on Apr. 28, 2006.

(51) Int. Cl.
*A63B 22/14* (2006.01)

(52) U.S. Cl. ..... 482/147; 482/34

(58) Field of Classification Search ..... 482/34, 482/79–80, 146–147, 51; 280/841, 600; D21/760, 764

See application file for complete search history.

(56) References Cited

U.S. PATENT DOCUMENTS 1,355,853 A * 10/1920 Salvator Habsburg-Lothringen . 180/6.54
3,224,785 A * 12/1965 Stevenson ..... 280/11.206
3,630,540 A * 12/1971 Smith ..... 280/87.042
3,833,215 A * 9/1974 Isdith ..... 482/51
3,942,449 A * 3/1976 Nelson ..... 104/107
4,073,356 A 2/1978 Schlicht
4,106,786 A * 8/1978 Talbott ..... 280/8
4,109,741 A * 8/1978 Gabriel ..... 180/21
4,505,477 A * 3/1985 Wilkinson ..... 482/146
4,600,073 A 7/1986 Honett
4,601,469 A * 7/1986 Sasser, Jr. ..... 482/146
RE32,346 E * 2/1987 Klamer et al. ..... 280/11.201
4,795,181 A * 1/1989 Armstrong ..... 280/87.042
4,984,648 A 1/1991 Strzok
5,020,621 A * 6/1991 Martin ..... 180/181
5,125,880 A * 6/1992 Peters ..... 482/68
5,152,691 A * 10/1992 Moscarello ..... 434/247
5,190,506 A * 3/1993 Zubik et al. ..... 482/68
5,487,441 A 1/1996 Endo et al.
D376,629 S * 12/1996 Mounts et al. ..... D21/412
5,839,737 A * 11/1998 Kruczek ..... 280/11.115
5,897,474 A 4/1999 Romero
6,017,297 A * 1/2000 Collins ..... 482/146
6,354,983 B1 * 3/2002 Lee ..... 482/132
6,796,394 B1 * 9/2004 Lin ..... 180/181
6,848,527 B2 * 2/2005 Nelson ..... 180/181
D529,565 S * 10/2006 Warner et al. ..... D21/765
7,172,044 B2 * 2/2007 Bouvet ..... 180/181
7,357,767 B2 * 4/2008 Tsai ..... 482/146
7,467,681 B2 * 12/2008 Hiramatsu ..... 180/188
7,479,097 B2 * 1/2009 Rosborough et al. ..... 482/146
2006/0049595 A1 * 3/2006 Crigler et al. ..... 280/87.042

(Continued)

*Primary Examiner*—Lori Baker
(74) *Attorney, Agent, or Firm*—Gene W. Arant

(57) ABSTRACT

A method and apparatus for achieving dynamic balance exercise by using an elongated board that is tiltable in a longitudinal direction and energized by a set of motor-driven wheels which are connected to oppose the tilting action. A front to back (pitching) and side to side twisting (yawing) of the board is accomplished concurrently with the longitudinal tilting (rolling) movement to balance the exercise experience and improve the subjects fore-and-aft balance.

18 Claims, 8 Drawing Sheets

U.S. PATENT DOCUMENTS

2006/0260862 A1 11/2006 Nishikawa
2008/0191433 A1* 8/2008 Bourne ..... 280/11.204
2008/0217079 A1* 9/2008 Marsh et al. ..... 180/65.2

* cited by examiner

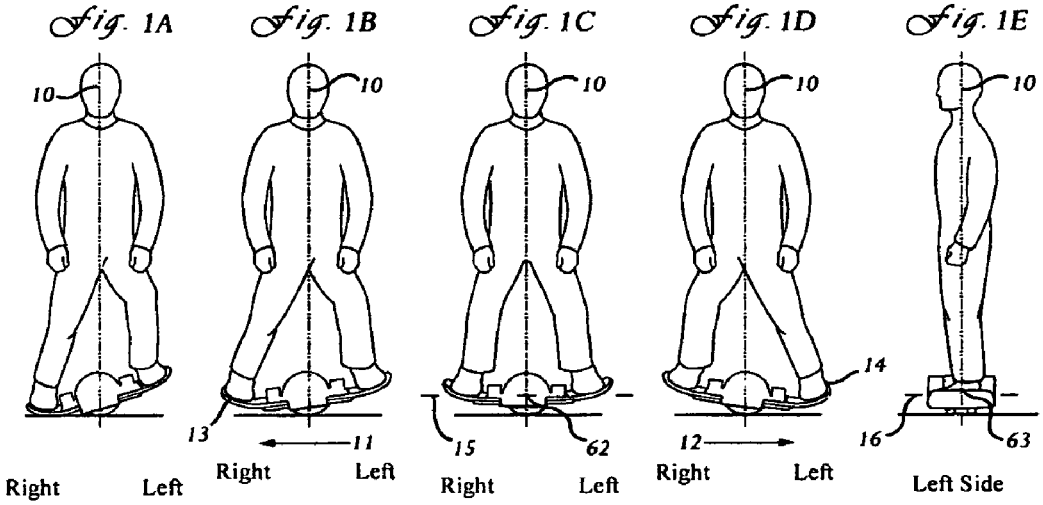
fig. 1A
fig. 1B
fig. 1C
fig. 1D
fig. 1E
10
13
11
15
62
12
14
16
63
Right
Left
Right
Left
Right
Left
Right
Left
Left Side
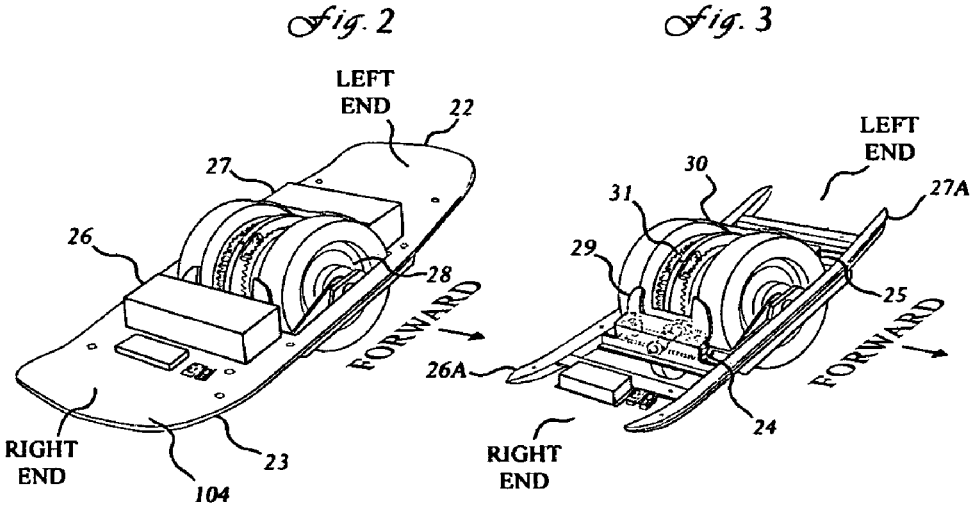
fig. 2
fig. 3
LEFT END
22
27
26
28
FORWARD
RIGHT END
23
104
LEFT END
30
31
27A
29
25
26A
FORWARD
24
RIGHT END Fig. 5
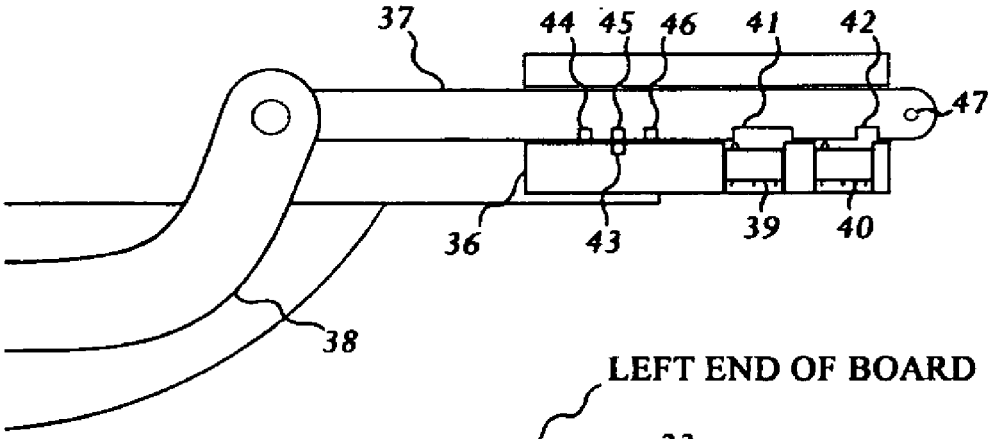
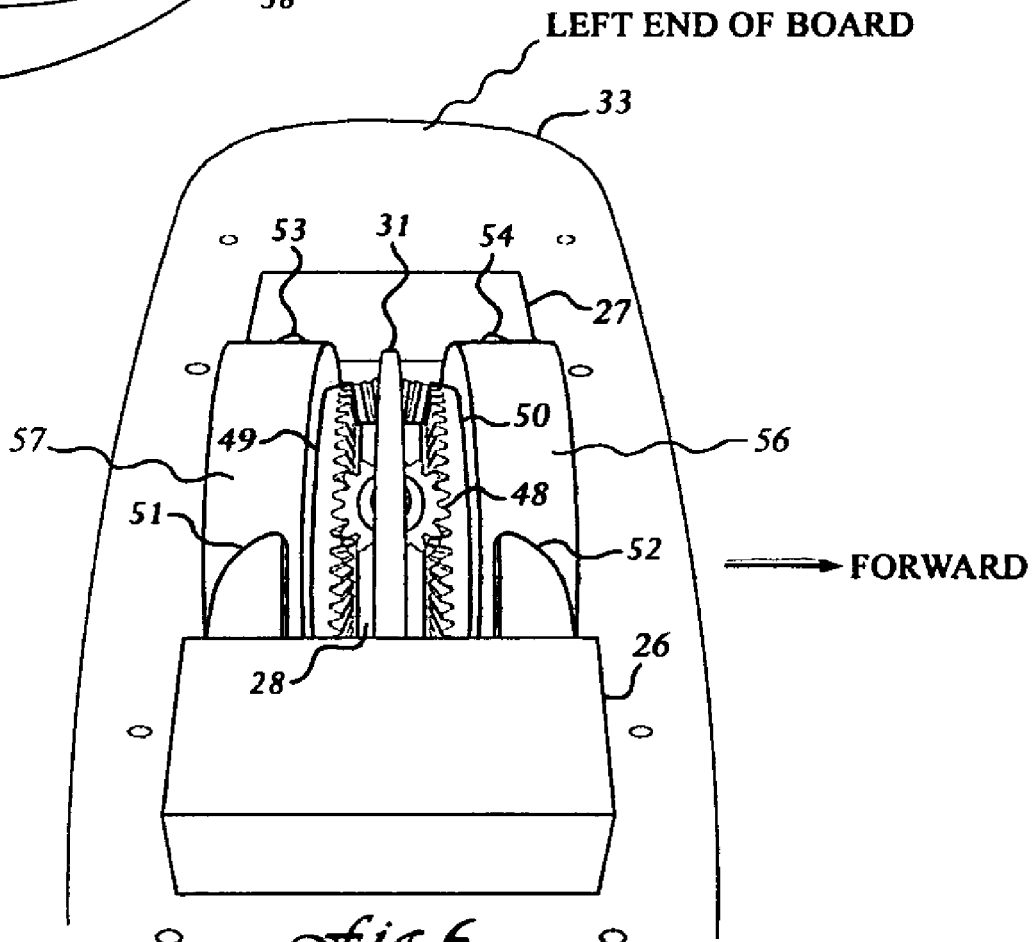
Fig. 6

Alternate Embodiments
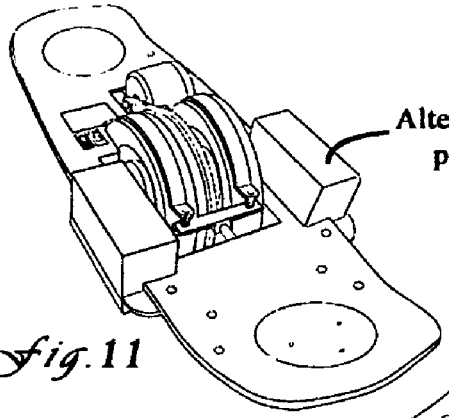
Fig. 11
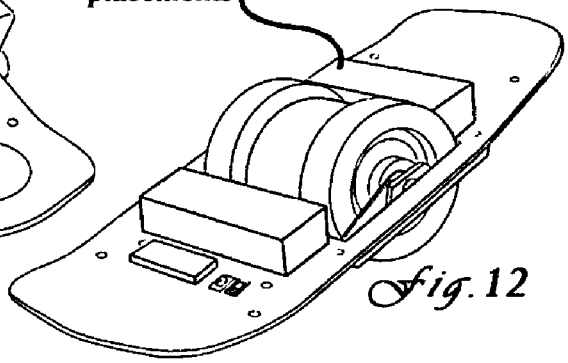
Fig. 12
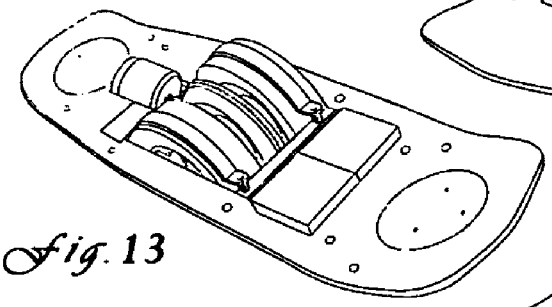
Fig. 13
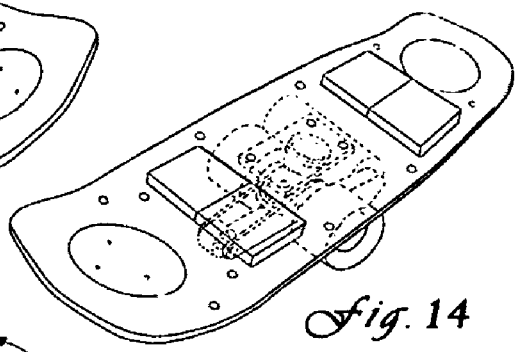
Fig. 14
Fig. 15
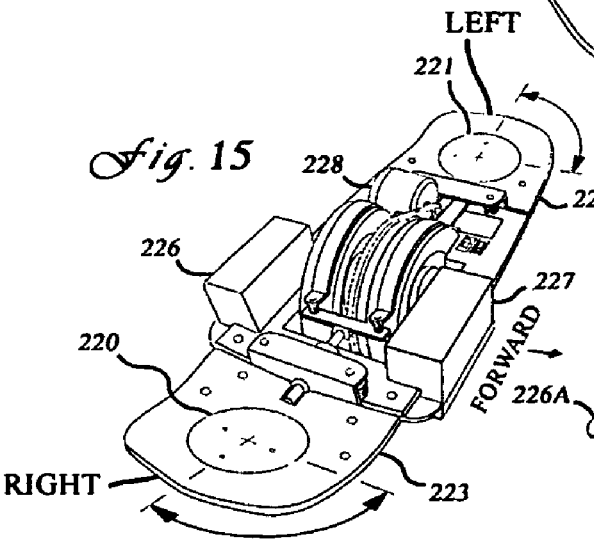
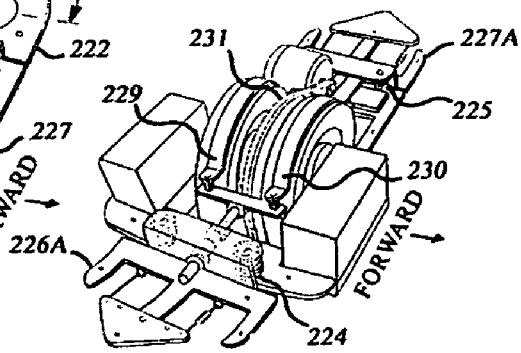
Fig. 16

3 Dimensional View
to define the
Geometry of Motion

MOTORIZED APPARATUS AND METHOD FOR DYNAMIC BALANCING EXERCISE

PRIORITY CLAIM

This application is a Continuation-in Part (CIP) of my prior application Ser. No. 11/796,608 filed Apr. 26, 2007 now abandoned which claimed priority of my Provisional Application Ser. No. 60/795,516 filed Apr. 28, 2006 and for which I again claim priority under Title 35 USC Section 120.

FIELD OF INVENTION

The field of this invention is exercise apparatus and methods.

BACKGROUND OF THE INVENTION, AND PRIOR ART

Many different types of apparatus have been devised for exercising the human body. A teeter-totter, also known as a seesaw, is a well-known children's play apparatus. It consists of an elongated board that is balanced at about its longitudinal center on a fulcrum, which is typically a saw-horse. Two children then sit on opposite ends of the board facing each other. If the heavier child raises his or her feet above the ground, his or her end of the board will go down and the other end of the board will then lift the other child up into the air. Balance of the board can also be changed by sliding it longitudinally on the fulcrum.

In addition to walking and performing various other tasks and exercises, a person who wants to remain healthy will also need to be able to reliably maintain his or her balance, dynamically as well as statically. Balance board assemblies provide for this type of exercise. A balance board assembly includes an elongated board that is balanced at about its longitudinal center on a fulcrum, and the length of the board is such that a person using the apparatus for exercise can straddle the fulcrum with their two feet on respective ends of the board at the same time. The person will then face in a direction perpendicular to the longitudinal axis of the board.

Some balance board assemblies utilize non-motorized supports to provide a movable fulcrum; that is, a fulcrum which is capable of rolling or twisting on a supporting surface so as to move the position of the board itself relative to that supporting surface. Assemblies of this type are shown in U.S. Pat. No. 5,897,474 to Romero in which the fulcrum is provided by a semi-flexible ball; Collins U.S. Pat. No. 6,017,297 which shows an elliptical type roller supporting the board for allowing the board to move with respect to ground; and U.S. Pat. No. 5,125,880 to Peters, where the fulcrum for the board includes a differential drive mechanism that permits the board to be twisted in the horizontal plane. Since in all three of those patents the movable support is non-motorized, the user must then move his or her body in order to move his or her center of gravity to drive the movements of the apparatus.

Nelson U.S. Pat. No. 6,848,527 shows a motorized board that can be driven in a forward direction only, along the longitudinal axis of the board; hence it should be categorized as a skate board, not a balance board. Endo U.S. Pat. No. 5,487,441 also shows a powered skate board. Stevenson U.S. Pat. No. 3,224,785 likewise shows a skate board device that can be powered for motion in a forward direction.

The Bouvet U.S. Pat. No. 7,172,004 shows a non-motorized self-propelled skate board in which energy provided by the user first winds a band affixed to a drum, so as to thereafter provide driving power for moving the board in a direction along its longitudinal axis. Bouvet does not show an independent source of energy for moving the board.

SUMMARY OF THE INVENTION

For any balance board apparatus there is at least a theoretical point at which not only is the balance board itself in equilibrium on its fulcrum, but the user of the apparatus is also in equilibrium upon the board. A basic concept of the present invention is that the most rigorous balance exercise to be experienced by a user of a balance board apparatus will be achieved if any loss of equilibrium of the user is automatically opposed by the apparatus.

According to one feature of the present invention the balance board is supported on a frame having four separate springs at the respective four corners of a rectangle, thus allowing the board to slant in either or both of two mutually perpendicular directions. The springs tend to automatically oppose any such slanting movements. This feature of the apparatus is similar to a conventional support for an automobile body upon its sub-frame.

According to another feature of the invention the balance board apparatus includes a wheel assembly providing a fulcrum at about the longitudinal center of the board, and the wheel assembly is selectively driven by an electric motor independently powered from a separate energy source, namely, a battery. A longitudinal slanting of the board, resulting either from a loss of equilibrium or from a shifting of the center of gravity of the person doing the exercise, will then activate the electric motor to drive the board longitudinally toward the downwardly slanted end of the board.

In still another feature of the present invention the wheel assembly of the balance board apparatus contains a parallel pair of wheels that are driven through a differential drive mechanism, which allows the board to move in a yawing or sidewise twisting action, in addition to its other movements.

In yet another feature of the invention a braking mechanism provided in conjunction with the differentially driven parallel pair of wheels is selectively operable to activate a yawing or sidewise twisting of the board in either direction. When the board is slanted in the direction of its longitudinal axis and is therefore being driven longitudinally, a pitching or fore-and-aft movement of the person who is doing the exercise activates the braking mechanism, which in turn causes a partial rotation of the board about its longitudinal axis.

Identifying the Three-Dimensional Exercises Motions

The operator of the balance board apparatus; i.e., the person doing the exercise, can move in any one or more of three types of movements. These are referred to as PITCH, ROLL, and YAW, using terminology that is already familiar in describing the movements of an aircraft or a boat. The person stands with his or her two feet straddling the fulcrum that supports the board near its longitudinal center. See FIG. 10, where the centerlines of footpads 17 and 18 are shown near the two ends of the board 104, and numeral 15 identifies the longitudinal center of the board that is supported by the fulcrum. FIG. 17 illustrates two-dimensional movements of the person's center of gravity 150 in either a left or a right direction, causing the board 104 to slant longitudinally, which represents a ROLLING movement as far as the person is concerned.

Any ROLLING movement of the person would normally be accompanied by a longitudinal slanting movement of the board 104, as shown in FIG. 17. A slanting movement of the board 104 would normally be accompanied by a ROLLING movement of the person. When the person has moved his or her center of gravity, or has shifted his or her weight from leg to the other, to cause the board to slant longitudinally, the motorized wheel assembly 120 will automatically drive the board in the direction of its downwardly slanted end. This action is described in more detail in later paragraphs.

FIG. 18 provides a three-dimensional illustration in perspective, where it is shown that when the person leans either forward or backwards, that is a PITCHING movement. This movement of the person may be accompanied by a partial rotation of the board 104 about its own longitudinal axis. FIG. 18 also shows that any twisting of the board in its own horizontal plane is described as a YAWING movement. Since the operator's feet are held in fixed positions on the footpads 110 and 112, the YAWING movement of the board is accompanied by a similar movement of the person.

DEFINITION OF TERMS

The following defines the geometry of the motion of the User of the present invention. FIG. 18 illustrates this action in picture form.

Leaning Action (forward or backward)=Pitch

Tilting Action (left or right)=Roll

Twisting Action (left or right in horizontal plane)=Yaw

The User is said to be in Equilibrium when they are Balanced in all three planes.

DRAWING SUMMARY

FIG. 1A is a frontal view of a preferred apparatus of the present invention showing subject at rest with apparatus positioned in its STOP mode. Subject's body position is vertical and perpendicular to the ground, represented by centerline (10);

FIG. 1B is a frontal view of the preferred embodiment of apparatus showing the subject pressing down with right foot (13) but not touching the ground, causing the apparatus to travel in the direction (11), to the subject's right. Subject's body position and center of gravity continues to stay perpendicular, as represented by centerline (10);

FIG. 1C is a frontal view of the preferred embodiment showing the subject standing in a neutral vertical position, with center of gravity at centerline (10), and a horizontal plane (15) that intersects centerline (10) at (62);

FIG. 1D is a frontal view of the preferred embodiment showing the subject pressing down with left foot (14) but not touching the ground, causing the apparatus to travel in the direction (12), to the subject's left. Subject's body position continues to stay perpendicular to the ground;

FIG. 1E is a side view of the preferred apparatus showing the subject standing erect in a fore-and-aft direction, where numeral 16 indicates the neutral position or equilibrium position in the fore-aft direction of the plane 15.

FIG. 2 is a perspective view of the presently preferred embodiment of the apparatus showing the board or platform 104 with its left and right ends (22, 23). Also shown are a pair of batteries (26, 27), and an electric hub motor (28);

Figure 4A:
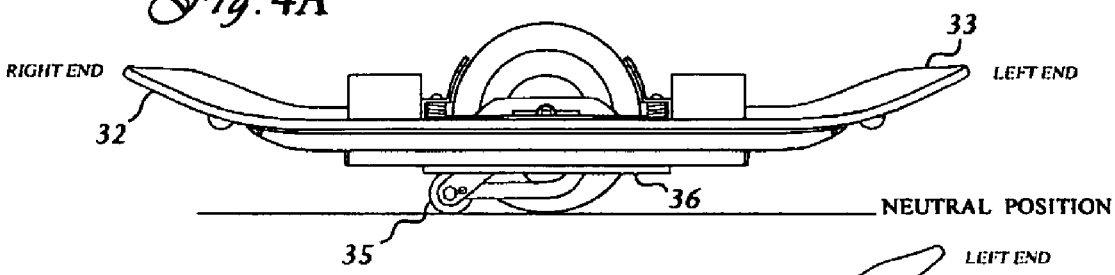

FIG. 3 is a perspective view of the preferred embodiment of FIG. 2 with the board or platform 104 removed to show a frame having a pair of side rails 26A, 27A which, in the assembled form of the apparatus, are secured directly to the undersurface of the board or platform 104. A spring assembly 24 is located at the right end of the sub-frame and a spring assembly 25 is at the left end. Each spring assembly includes a compression spring 60 on the rearward side and a forward compression spring 61 (see FIG. 9). The compression springs of each spring assembly are attached at their upper ends to a cross-arm (not specifically numbered) that extends between the side rails of the sub-frame. As shown in FIG. 9, the compression springs 60, 61 have their bottom ends supported upon an under carriage (not specifically numbered) which in turn is supported by the shaft or axle 19 of the wheel assembly 120.

Figure 4B:
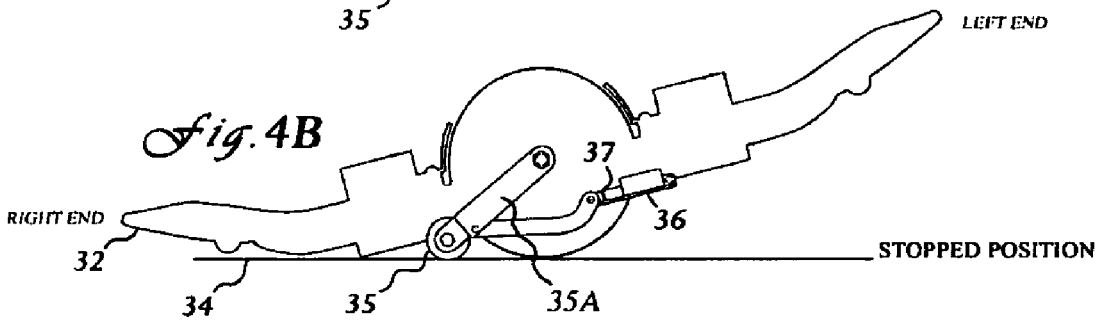
Figure 4C:
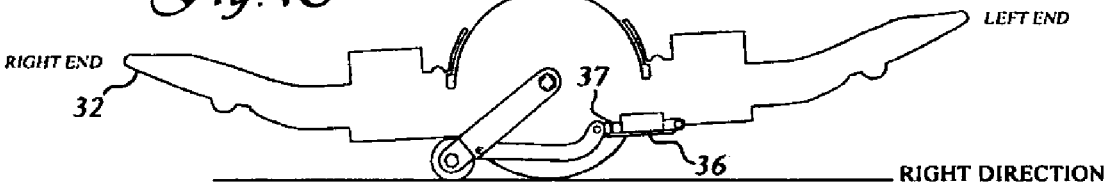
Figure 4D:
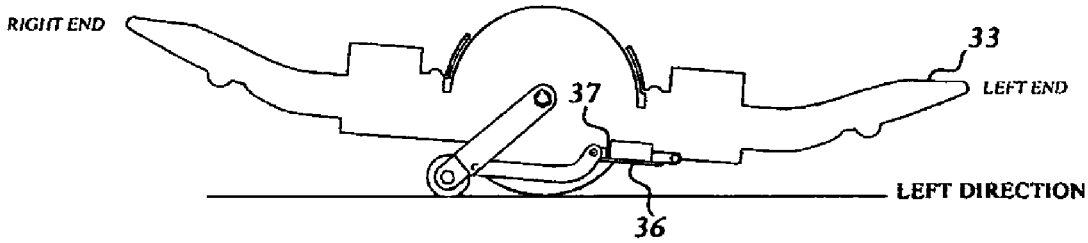

FIG. 4A is a frontal view of the preferred embodiment in a neutral position. The right end (32) of the board 104 is level with its opposing or left end (33). A single axis wheel (35) is carried on the end of an input arm (35A), which connects to an input switching control unit (36);

FIG. 4B is a frontal view of the preferred apparatus of the present invention, showing members of the switching control unit 36, in a stopped position of the apparatus. Right end (32), of the board or platform (104) is pressed down to the ground (34). A single axis wheel (35) is carried on one end of an input arm (35A) whose other end is supported from the wheel assembly axle 19. Input arm 35A is connected by linkage to the input switching control unit (36). Item (37) shows a reference mark on the input switching control unit (36) for comparison;

FIG. 4C is a frontal view of the preferred embodiment of the present invention positioned to travel in the right direction. Item (32) shows the right end of the platform no longer touching the ground. Reference mark (37) has changed position on the input device (36);

FIG. 4D is a frontal view of the preferred embodiment of the present invention positioned to travel in the left direction. Item (33) shows the left end of the platform having been partially pressed down. Reference mark (37) has again changed its position on the input device (36);

FIG. 5 is a cutaway side view of the preferred embodiment of the present invention, illustrating input devices communicating members. Linkage from an input control arm (38) is connected to input device slider (37) that is slidable within input device-housing (36). Polarity and shut off switches (39, 40) are shown with their corresponding notched timing areas (41, 42). A "Hall Effect" detector is shown (43), and its corresponding magnets shown (44, 45, 46). Input devices secondary connection point (47) on the end of slider 37 is an optional feature that is used in an alternate embodiment to override input control arm by connecting to the rotating foot controllers shown in FIG. 15 numbers (220,221);

FIG. 6 is a lengthwise partial plan view of the preferred apparatus of the invention with board 104 indicated only in outline form, illustrating the motorized drive system and its members. A pair of parallel drive wheels (56, 57) are supported on the axle (19) of wheel assembly (120), not shown in FIG. 6. Item (33), represents an end of the platform 104. Item (28) is an electric hub motor drivingly connected to differential pinion case (31). Pinion case (31) mates through a set of pinion gears (48) with differential rack gears (49, 50) and braking system consisting of left and right tabs (53,54,51,52) and batteries (26,27).

Figures 7A, 7B, 7C:
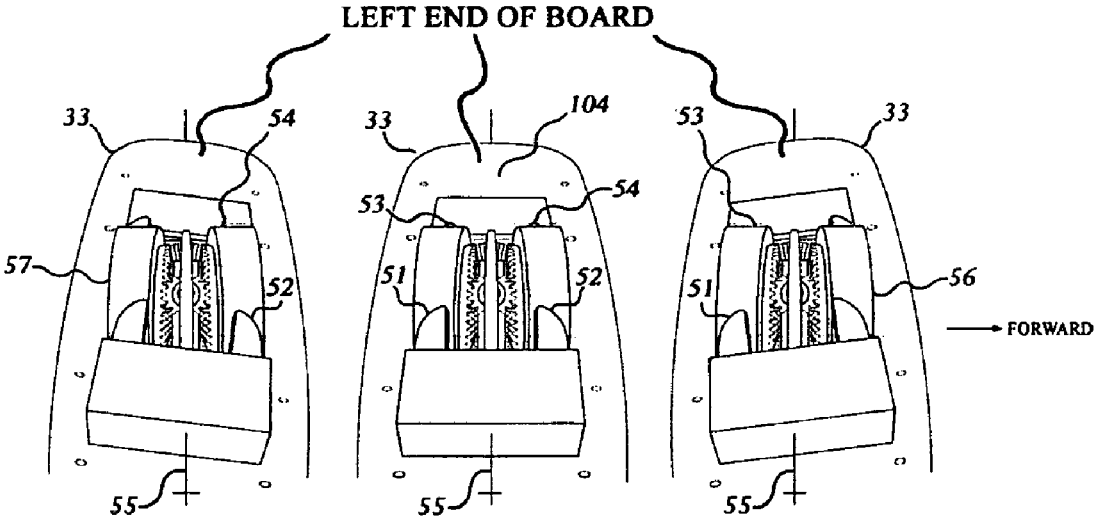
Figures 8A, 8B, 8C:
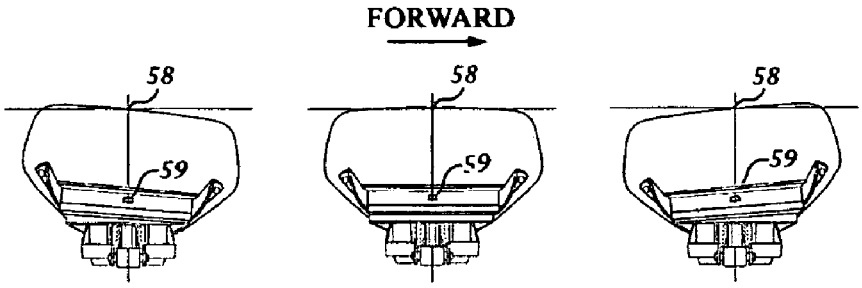
Figures 9A, 9B, 9C:
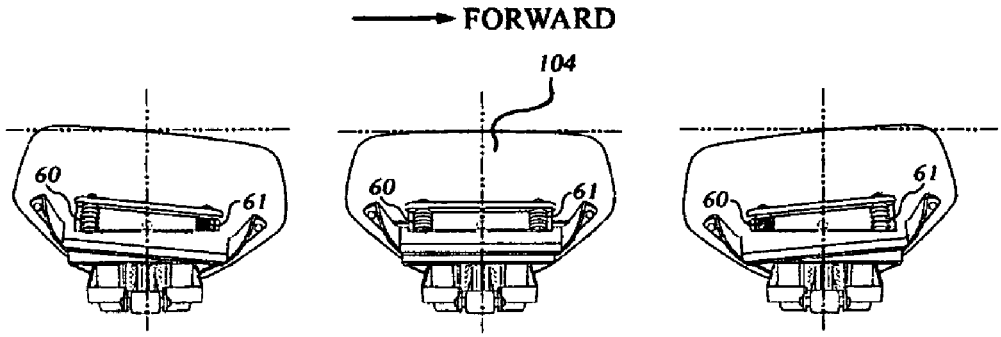
Figure 10:
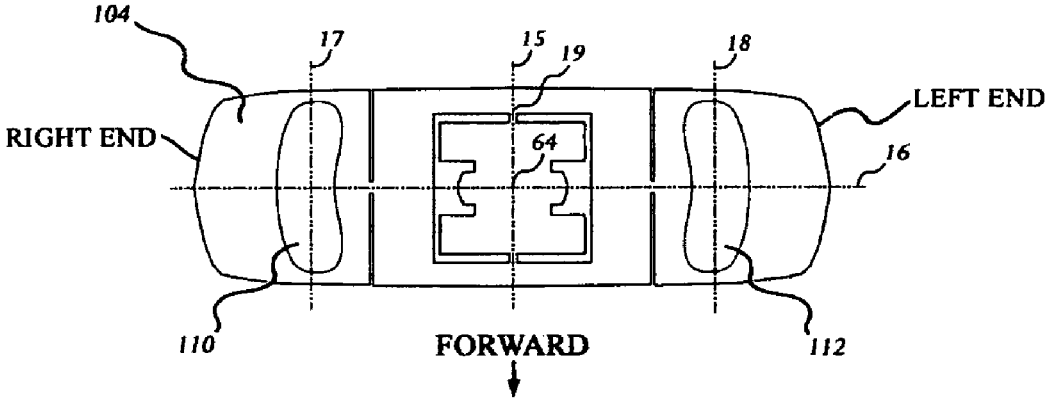
Figure 17:
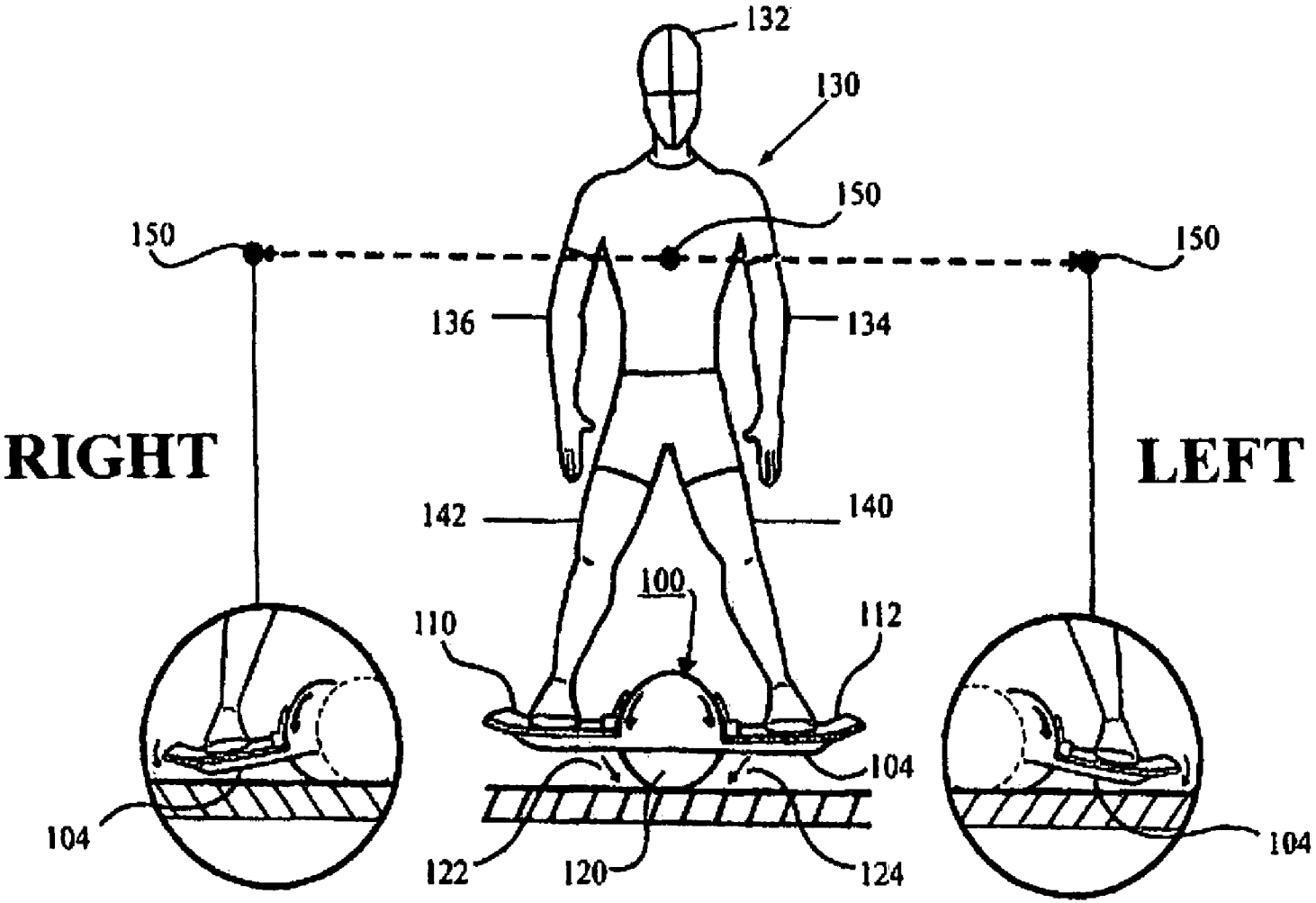
Figure 18:
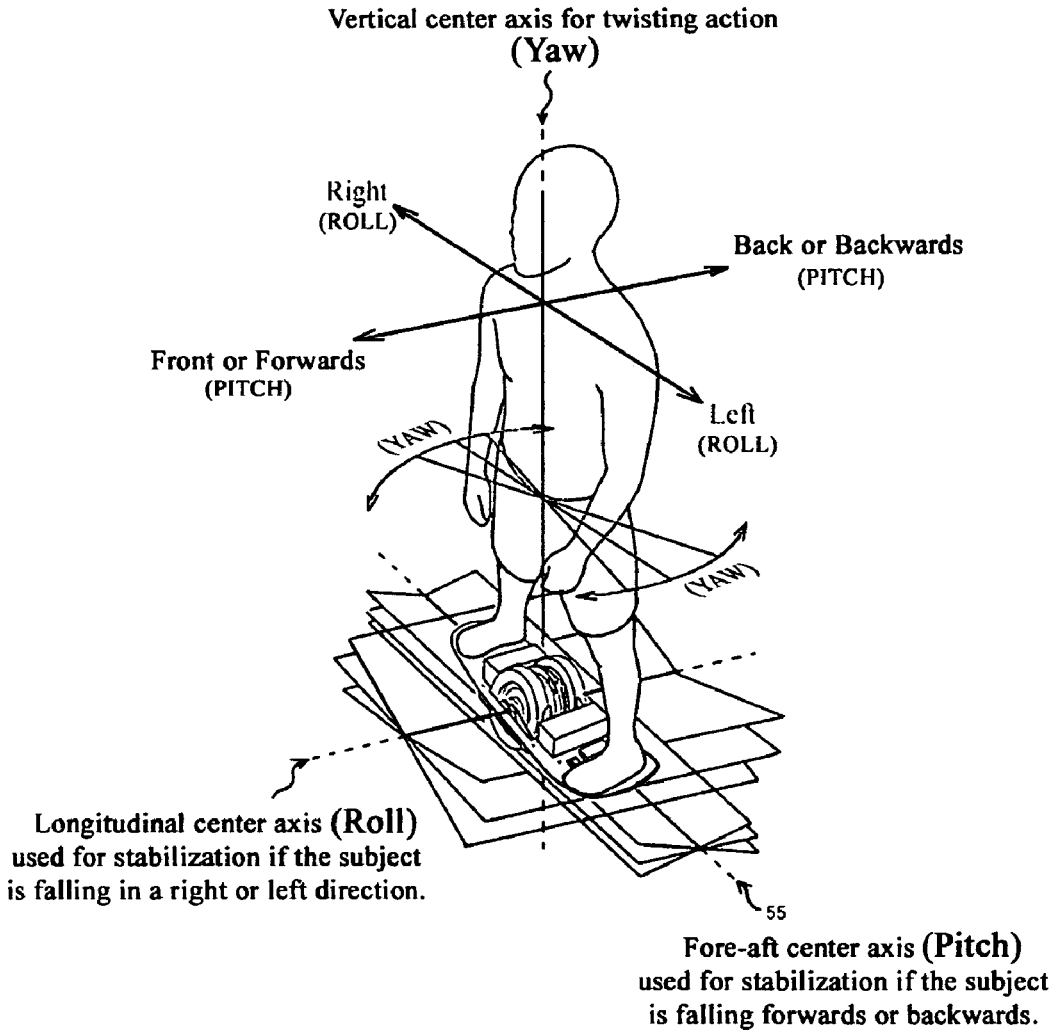

FIGS. 7A, 7B, 7C, are lengthwise plan views of the preferred embodiment showing again the board 104 indicated in outline form. Three different illustrations are shown of pivoting movement in the fore-aft plane that may generate a sideways twisting motion or YAW. The movements illustrate mechanical braking and acceleration of the motorized drive system. FIG. 7B represents the platform (104) in its centered position represented by centerline (55); numeral (33) representing the end of the platform (104). Braking tabs (51, 52, 53, 54), are then applying zero (0) friction to drive wheels;

FIG. 7A illustrates the preferred embodiment with the platform (33) pivoted slightly forward in a pitching movement. Centerline (55) represents the fore-aft plane. Braking tabs (52, 54) are making contact to drive wheel (56) causing braking to wheel (56), wherein acceleration occurs in the motorized drive system's adjacent wheel (57), because of the differential's inherent gearing advantage;

FIG. 7C illustrates the preferred embodiment of the present invention pivoting in a fore-aft plane in the direction opposite to that of FIG. 7A, represented by centerline (55), and end of platform (33). Braking tabs (51, 53), are making contact to drive wheel (57), causing braking to wheel (57), wherein acceleration occurs in the motorized drive system's adjacent wheel (56), because of the differential's inherent gearing advantage;

FIGS. 8A, 8B, 8C, are end views from ground level of the preferred embodiment of the present invention showing the sub-platform pivoting in the fore-aft plane. Platform's change in the fore-aft plane is represented by vertical and horizontal centerlines (58), and center of pivot is shown in item (59);

FIGS. 9A, 9B, 9C, are end views from ground level of the preferred embodiment of the present invention showing an exposed view of one end of a spring assembly, in the fore-aft plane. FIG. 9B illustrates the platform in a level position. It also illustrates centering springs (60, 61), providing equal upward pressure to support the board 104, using fifty (50) percent of compression travel;

FIG. 9A illustrates the preferred embodiment of the present invention, pivoting in a fore-aft plane in a direction reflecting compression of the spring (61). Compression spring (61) is using one-hundred (100) percent of its compression travel, whereas spring (60) is using zero (0) percent of its compression travel;

FIG. 9C illustrates the preferred embodiment of the present invention, pivoting in a fore-aft plane in the direction opposite to FIG. 9A. The compression spring (60), is using one-hundred (100) percent of its compression travel wherein spring (61), is using zero (0) percent of its compression travel;

FIG. 10 is a top view of the presently preferred apparatus of the present inventon showing footpads 110, 112, with their centerlines (17, 18) for positioning the subject's feet. It also illustrates the lateral axis (19) of the motorized wheel assembly; a literally extending horizontal plane (15) about which the longitudinal tilting of the board may occur, and the horizontal plane (16) about which the subject's fore-aft movement may occur. Item (64) represents the intersection of the planes 15 and 16 at a vertical center for YAW movement. See FIG. 18 for the illustration of all three planes;

FIG. 17 is a frontal view of an artistic drawing, which schematically illustrates the method of operating the preferred apparatus of the present invention for ROLLING movements of the subject; and FIG. 18 is a three-dimensional view of the preferred apparatus of the present invention showing the user standing erect, and all of the possible movements (pitch, role, and yaw) of the user with respect to the apparatus.

PARTS LABELING FOR THE PREFERRED EMBODIMENT

FIGS. 1 through 10, 17 and 18

10 The Centerline of the User
11 Users direction traveling to the right
12 Users direction traveling to the left
13 User pressing down with the right foot
14 User pressing down with the left foot
15 The neutral position of the horizontal plane (where the longitudinal tilting of the board may occur)
16 The neutral position of the Fore-aft Plane
17 Centerline position of the right foot
18 Centerline position of the left foot
19 Lateral Axis of the Motorized Wheel Assembly
22 The left end of the Board
23 The right end of the Board
24 The right spring assembly
25 The left spring assembly
26 The right battery
27 The left battery
26A The right end support frame
27A The left end support frame
28 The electric hub motor
29 The right end braking tabs
30 The left end braking tabs
31 The differential pinion case
32 The right end of the board in the Neutral, Stopped and Right Position
33 The left end of the board in the Neutral, Stopped and Left Position
34 When the board is pressed downed to the ground in the Stopped Position
35 The single axis wheel
35A Input Control Arm
36 Switching control unit
37 The Reference Mark on the Input device (Input device slider) (This will change as the board is tilted to the left or right)
38 The linkage from the input control arm
39 Polarity and shut off Switch 1
40 Polarity and shut off Switch 2
41 Notched timing area for switch 1
42 Notched timing area for switch 2
43 The "Hall Effect" detector
44 Magnet 1
45 Magnet 2
46 Magnet 3
47 Secondary connection point for Input device (Used in the Alternate Embodiment only)
48 The differential pinion gear
49 The rearward mating differential rack gears
50 The forward mating differential rack gears
51 The right rearward braking tab
52 The right forward braking tab
53 The left rearward braking tab
54 The left forward breaking tab
55 The Centerline of the platform
56 The forward Drive Wheel
57 The rearward Drive Wheel
58 The platform changes in the fore-alt plane represented by vertical and horizontal centerlines
59 The center of pivot in the fore-aft plane
60 A Pair of rearward compression springs
61 A Pair of forward compression springs
62 The intersection of the vertical and longitudinal plane when the user is standing on board (This illustrates the user in equilibrium)
63 The intersection of the vertical and fore-aft plane when the user is standing on the board

64 The intersection of all the of the planes described (Vertical, Longitudinal, Fore-aft)

Labeling for FIG. 17

100 The Motorized Apparatus
104 The Elongated Board
110 The Right foot supported area
112 The Left foot supported area
120 The Wheel Assembly
122 The Right drive Linkage Control
124 The Left drive Linkage Control
130 The Person or (USER)
132 The Head of the Person
134 The Left Arm of the Person
136 The Right Arm of the Person
140 The Left Leg of the Person
142 The Right of the Person
150 The Persons Center of Gravity Illustration of the Rolling Movements Drawing FIG. 17

Referring now to drawing FIG. 17, a principal method feature of the present invention is illustrated there. Artistic license is taken for purpose of illustration, showing some parts in expanded or schematic form, and distances exaggerated for clarity of description. A motorized apparatus 100 includes an elongated board 104 which has foot-supporting areas 112, 110, on its respective ends. The motorized apparatus includes a wheel assembly 120 positioned underneath the board near its longitudinal center. Left and right drive linkages 124 and 122 control the motorized drive for the wheel assembly in response to any longitudinal slanting or tilting actions of the board. In FIG. 17 a person 130 is assumed to be in a forward facing position, with head 132, left and right arms 134, 136, and left and right legs 140, 142. The person's center of gravity or mass is indicated by a solid dot 150, which is the centroid of the person. The person by moving his or her legs, or by other motion, may move the centroid left or right, or forward or back.

The extended illustration in the right hand portion of FIG. 17 shows the person 130 facing forward pressing down left end of platform, having moved the centroid 150 to the left. It is seen from dotted lines in the LEFT position that the left end of the board 104 has tilted downward. That movement has triggered operation of a left drive linkage 124 which, as shown by dotted lines, has then caused the wheel assembly to be driven a short distance to the left from its original or previous position.

The driving energy is provided from an independent source, to activate a hub motor 28, FIG. 6, associated with the wheel assembly 120. The illustration at the left of FIG. 17 marked RIGHT on the drawing shows response of the board 104 through drive linkage 122 when the centroid 150 of the person's body moves in the other direction, to the right. Again, the wheel assembly has been driven a short distance from its original or previous position, this time to the right, as shown by dotted lines.

In the event the user is able to shift weight from one foot to the other without shifting their center of gravity 150 in the lateral direction, that action could initiate operation of the drive motor.

While FIG. 17 shows separate left and right drive linkages 124, 122, in the preferred form of the apparatus as shown in FIGS. 1-10, it is actually a single switching control unit (36), FIGS. 5 and 6, that controls the movements in both directions.

Other Three-Dimensional Movements

FIG. 18 illustrates the three-dimensional aspect of the apparatus of the present invention which provides an opportunity for the user to dynamically control movement of his body in three-dimensions, described as Pitch, Roll and Yaw. The fore and aft direction (Pitch) is perpendicular to the longitudinal axis of the board 104. This fore and aft movement may also generate sidewise twisting movement (Yaw) in the horizontal plane of the board, or a left or right leaning movement (Roll) perpendicular to the fore-aft axis of the board, or all three depending on the actions (balance or weight shifting) of the user. These capabilities are provided by the unique drive controls for the wheel assembly in the motorized drive apparatus.

DESCRIPTION OF THE PREFERRED EMBODIMENT

Drawing FIGS. 1 through 10, 17 and 18

The elongated board 104 is supported at its longitudinal center by a fulcrum that is mainly provided by the wheel assembly 120. As shown in the artistic illustrations of FIGS. 1 and 17, the wheels of the wheel assembly preferably protrude upwardly though a central opening at the longitudinal center of the balance board. The protruding wheels do not interfere with the user's feet placed on footpads 110, 112.

The board 104 is not directly supported by the wheel assembly 120, however. Longitudinally extending ribs 26A, 27A, are fixedly secured to the undersurface of the board—see FIGS. 2 and 3—and act as a supporting frame for the board. An additional and separate sub-frame is provided below the ribs 26A, 27A, and the afore-mentioned ribs are springably supported upon and from the sub-frame. See FIGS. 8A, 8B, 8C, 9A, 9B, and 9C. The sub-frame is not identified by a specific numeral in the drawings, but supports coil or compression springs 60, 61, at its four corners. Each coil or compression spring has a lower end secured to the sub-frame and has an upper end engaging a cross-bar, also not specifically numbered, that extends between and is fixedly secured to the ribs 26A, 27A.

In the wheel assembly 120 the common shaft or axle 19 representing the lateral axis of the motorized wheel assembly is fixedly and non-rotatably supported within the sub-frame. There are a parallel pair of drive wheels 56, 57, both of which are rotatably supported upon the common shaft or axle 19. The shaft 19 in turn supports the sub-frame from the drive wheels, which rest upon the ground. A hub motor 28 is cooperatively mounted between the horizontal shaft 19 and a differential pinion case 31.

The motorized wheel assembly receives its driving energy from one or more batteries 26 and 27 attached to the balance board apparatus. When the board 104 is parallel to the supporting ground surface, the switching control unit 36 provides minimal or no output from the batteries to the hub motor 28. When either the right or left end of the board 104 is pressed or tilted downward, the switching control unit 36 is designed to determine both the polarity and the electrical output level of energy provided from the batteries to the motor 28. When the slanting or tilting of the board increases, there is an increase in the output level of energy provided to the hub motor 28. As the switching control output level increases or decreases, it occurs in a smooth ramping manner so as to avoid any jerking of the board 104. Thus controlling the direction and speed of the hub motor 28. In the preferred apparatus this function is achieved by using a transducer or potentiometer 43 that operates on the Hall Effect principle; FIG. 5.

The hub motor is an electric motor built directly into the hub of a wheel, which in this instance is the pinion case 31. The drive wheels 56, 57, are equipped on their mutually facing inner sides with rack gears 49,50. Hub motor 28 therefore imparts rotating drive to the drive wheels 56, 57, through the pinion case 31, a set of pinion gears 48 shown in FIGS. 2, 3, and 6, and the rack gears 49, 50. Thus any driving action by hub motor 28 drivingly rotates the pinion case 31 and pinion gears 48, which then impart differential driving rotation to either or both of the drive wheels 56, 57, in a well known manner.

The support of balance board 104 on the frame 26A, 27A by four separate compression springs at the respective four corners of a rectangle allows the board to slant in either or both of two mutually perpendicular directions. The springs tend to automatically oppose any such slanting movements. This feature of the apparatus is similar to a conventional support for an automobile body upon its frame. A slanting movement of the board 104 relative to the sub-frame, opposed by the springs, then initiates a braking action on either one or the other of drive wheels 56, 57, as described in detail in later paragraphs.

A braking mechanism provided in conjunction with the differentially driven pair of drive wheels is selectively operable to activate a yawing or sidewise twisting of the board in either direction, in addition to its other movements. When the board 104 is slanted in the fore-aft plane tabs (51, 53) or (52, 54), create a braking action on the drive wheels 57, 56. When the board is slanted in the direction of its longitudinal axis and is therefore being driven longitudinally, a pitching movement in the fore-aft plane of the person who is doing the exercise activates the braking mechanism, which in turn causes a partial rotation of the board about its longitudinal axis. The subject may also pivot the apparatus by using his or her lower body muscles in the fore-aft plane. This would apply braking to the back wheel and acceleration to the front wheel; see FIGS. 7A, 7B, 7C, which illustrate moving the apparatus in a directional arc from center to back, along the ground surface. This directional travel helps the subject correct himself or herself back to a vertical stance in the fore-aft plane (16). It can also be said that if the subject is falling forward, similar forward braking occurs. The motorized drive system is important to this feature. It is necessary for locomotion of the apparatus to be taking place in either a right or left direction, before braking can occur in the fore-aft control feature.

The objective of the present invention is to provide a means in which the subject dynamically uses the muscles in their body, and to create a fun activity at the same time. The present invention has a platform on which the subject stands as shown in FIG. 10, positioning their feet in a direction, parallel to one another (17, 18); that is, parallel to the axis (19) of a ground contacting drive assembly. The ground contacting drive assembly is motor driven FIG. 2, (28) to move the embodiment in either a right or left direction FIGS. 1B and 1D (11, 12).

The vertical plane in which the subject stands over the ground contacting drive assembly FIG. 10, defines an intersection (64) of the lateral and fore aft planes. In FIGS. 1B, 1C, 1D the forces of the subject's lower body controls locomotion of the embodiment by pressing down with either their right or left foot (13, 14) pivoting the platform on the motorized drive system in a lateral plane (15). If the subject decides to lean with their upper body and not use their legs the subject will fail, stopping the apparatus. It is critical that the subject uses only their legs for balance and maintain a vertical position with their upper body (10). This is controlled by, a braking assembly (tabs 51,52,53,54) that are directly related to the motor driven portion of the embodiment. FIGS. 8A, 8B, 8C illustrate the fore-aft movement (58), how the subject can slow either the front wheel (56) or back wheel (57) of the drive assembly FIGS. 7A, 7B, 7C. The stabilization occurs because of a differential between the drive wheels FIG. 6. The inherent nature of the differential's gearing immediately applies acceleration to the adjacent wheel wherein the apparatus is forced to turn in a directional arc around the ground contacting point of the slowed wheel. This feature allows the subject to move the platform beneath them, in a direction that keeps their center of gravity directly centered above the embodiment FIG. 1E, (10, 63), therefore increasing their stability in the fore-aft plane (16).

As mentioned earlier, the subject can achieve stability in the lateral plane FIG. 1C (15), by use of the motorized drive system FIG. 2 (28), by pressing the platform down on either the right or left end respectively (22, 23).

The following might give a better understanding wherein the subject gains stability in the fore-aft plane. Furthermore, if the subject starts to fall back or balance on the fore-aft plane FIG. 1E (16), the subject can pivot the embodiment using their lower body muscles on its fore-aft plane. This applies braking to the back wheel and acceleration to the front wheel FIGS. 7A, 7B, 7C, moving the embodiment in a directional arc from center to back, along the ground surface. The front wheel is defined as moving the embodiment as to help the subject correct them back to a vertical stance in the fore-aft plane FIG. 1E (16). It can also be said that if the subject is falling forward, similar forward braking occurs. The motorized drive system is important to this feature. It is necessary for locomotion of embodiment in either a right or left direction to occur, before braking can occur in the fore-aft control feature.

FIG. 9A illustrates the preferred embodiment of the present invention, pivoting in a fore-aft plane in a direction reflecting compression of the centering spring 61. Compression spring (61), is using one-hundred (100) percent of its compression travel wherein spring (60), is using zero (0) percent of its compression travel.

FIG. 9C illustrates the preferred embodiment of the present invention, pivoting in a fore-aft plane-in the opposite direction of FIG. 9A. The compression spring (60), is using one-hundred (100) percent of its compression travel wherein spring (61), is using zero (0) percent of its compression travel.

Thus, the invention provides an apparatus that automatically responds to a longitudinal tilting or slanting action of the elongated board by tending to drive the board in an oppositely oriented tilting or slanting movement. Furthermore, the motorized drive mechanism is also able to twist sidewise or yaw in a horizontal plane, and to lean or pitch forward or backward relative to the longitudinal axis of the board, in the fore-and-aft plane for a person using the apparatus. This then can provide a three-dimensional or dynamic movement for the person using the board. FIG. 18 illustrates this action in picture form.

More specifically, according to the principal feature of the invention the method of achieving dynamic balance exercise is carried out as follows. An elongated generally flat balance board is selected having a foot-supporting area on its upper surface at each of its ends. A wheel assembly is placed at about the longitudinal center of and at least partially underneath the balance board to provide a fulcrum for supporting the balance board in a longitudinally tiltable position above the ground. The person then places his or her feet on respective foot-supporting areas of the upper surface of the board so that he or she then faces in a direction generally perpendicular to the longitudinal axis of the board. Starting from a horizontal or balanced position of the board, the person then moves his or her center of gravity in a lateral direction parallel to the longitudinal axis of the balance board to produce a tilting or slanting movement of the board about the wheel assembly. In response to that tilting action of the board, the motorized drive mechanism energized from an independent source drivingly rotates the wheel assembly so as to shift the wheel assembly and fulcrum location along the ground, in generally the same direction that the person's center of gravity had been moved so as to drive the wheel assembly and board in that direction and thus to oppose that tilting action.

The apparatus of the present invention also provides an opportunity for the user to control movement of the board in a fore and aft direction; that is, perpendicular to the longitudinal axis of the board. This fore and aft movement or (pitch) can be also combined with a sidewise twisting movement (yaw) in the horizontal plane of the board, and a left or right leaning or tilting movement (roll) or a combination of all three. These capabilities are provided by unique drive controls for the wheel assembly in the motorized drive apparatus.

Method of Use

How to Use the Balance Board in the Preferred Embodiment

At first the balance board is at rest in the stopped position when one end of the board is resting on the ground with the right side down as illustrated in FIG. 4B. This is further illustrated in FIG. 1A when the user first mounts and straddles the board by placing their feet on each end of the board. The right leg is down at this point in the stopped position As the user shifts their weight to left leg the board will start to move to the right when the motorized drive mechanism drivingly rotates the wheel assembly as in FIG. 1B. In order to counter this movement the user must shift their weight to the left leg and the board will move, through the neutral position as illustrated in FIG. 1C, to the left as in FIG. 1D.

At this point the user is now moving to the left. In order to counter act this movement the user must again shift their weight to the right. The user will experience a teeter-totter movement as they tilt left and right. By now they will be experiencing not just a left and right movement of the board but a forward and back movement and a twisting action as they are now in a complete balancing exercise experience.

In order to stop the exercise the user will just place their weight on their leg and the balance board will stop all movement and the user can then dismount.

Parts Labeling for the Alternate Embodiments

FIGS. 11 through 16

220 Right Foot Controller of the Board in the Alternate Embodiment
221 Left Foot Controller of the Board in the Alternate Embodiment
222 The left end of the Board
223 The right end of the Board
224 The right spring assembly
225 The left spring assembly
226 The rear battery
227 The forward battery
226A The right end support
227A The left end support
228 The belt driven electric motor
229 The right braking tab (strap)
230 The left braking tab (strap)

Alternate Embodiments

Drawing FIGS. 11 Through 16

There are alternate forms of the present invention, wherein the left and right foot controls if desired can be rotated in a plane parallel to the platforms surface FIG. 15 (220, 221). This is to provide adjustments to any of the embodiment's features. This feature will accentuate the twisting or YAW action of the users body. The foot controllers allow the subject to have greater balance in a fore-aft plane. One example of adjustment might be to alter the platforms angle in its lateral plane (15) as illustrated in FIG. 1C, compensating for any irregularities in the grounds surface. This is accomplished by changing the location of the switching controls (36), input device over ride (47) found in FIG. 5. Should the ground level have a slope for example, the subject could compensate for this by rotating the foot controllers (220, 221). This rotation would elevate or drop either end of the platform, respectively, pivoting on its lateral plane (15) as illustrated in FIG. 1C. A motorized drive system (228, 231) provides locomotion to the embodiment. Its power plant can consist of one or more batteries (226, 227) or a fuel to provide energy to a combustion powered engine. The user uses lower body as described in the preferred embodiment to control input devices FIG. 5 (37) that send signals to the switching control unit (36). The switching control unit, controls the speed and direction of the motorized drive system, magnets (43, 39, 40) and switches (39, 40). A frame assembly connects all embodiment members as a unit, allowing them to work with one another respectively, as well as reinforcing the platform on which the subject stands FIG. 16 (226A, 227A).

The following are descriptions of the FIGS. 11, 12, 13, 14, 15, and 16 which represent alternate forms of the present invention:

FIG. 11, is a perspective view of an alternate form of the present invention. Illustrating a solid platform that pivots on the fore-aft and lateral planes that uses curved braking straps and external motor with drive chain. The battery placement has also been changed;

FIG. 12, is a perspective view of an alternate form of the present invention. Illustrating a solid platform that pivots on the fore-aft and lateral planes wherein the differential has been removed and mechanical linkage turns the motorized drive system. This method provides less turning ability than the preferred method;

FIG. 13, is a perspective view of an alternate form of the present invention. Illustrating a solid platform that pivots on the fore-aft and lateral planes wherein drive wheels have been widened apart from each other on their axis. The battery locations have changed and the drive motor runs perpendicular to the axis of the ground contacting drive system;

FIG. 14, is a perspective view of an alternate form of the present invention wherein the platform is solid and conceals the ground contacting drive system because, the ground contacting drive system uses smaller wheels and smaller drive motor. Pivoting on the fore-aft plane will turn the embodiment through the use of a modified skateboard type truck wherein braking to the front and back wheels are not necessary;

FIG. 15, is a perspective view of yet another alternate form of the present invention where the ends (222, 223) pivot on the fore aft plane separate from the middle section and are connected to one another by curved braking straps. The external motor (228), uses a chain drive system to power the differential. Also shown are the rotating foot controllers (220, 221) and the battery location (226, 227) has been changed to accommodate the external motor;

FIG. 16, is an exposed view of the apparatus FIG. 15, showing the frame assembly that supports the platform. End sections (226A, 227A) pivot on the fore-aft plane with centering springs (224,225). Also shown is the chain drive to differential (231), and braking straps (229, 330). This method operates exactly the same as the preferred method but does not require a hub motor assembly;

While I have described a presently preferred and alternate form of the invention in detail in order to compile with the patent laws, it will be understood that the scope of the invention is to be interpreted only in accordance the appended claims.

What I claim is:

1. A balance board exercise apparatus comprising, in combination:

an elongated board having a supporting frame;

a sub-frame underneath the frame;

a wheel assembly having a shaft non-rotatably secured within the sub-frame to provide a fulcrum for supporting the board from the ground at its longitudinal center, the board having a pair of footpads on its upper surface on respective sides of the fulcrum;

a parallel pair of drive wheels rotatably supported upon the shaft and equipped with rack gears on their mutually facing sides;

a differential pinion case mounted upon the shaft and drivingly engaging the rack gears for differentially driving the wheels;

a hub motor co-operatively mounted between the shaft and the differential pinion case; and control means including a switching control unit, a single-axis wheel supported on the ground, and a linkage from the single-axis wheel to the control unit which is responsive to movements of the elongated board relative to ground to activate the hub motor.

2. Apparatus as in claim 1 which further includes at least one battery attached to the balance board apparatus; the switching control unit controlling the flow of energy from the battery to the hub motor.

3. Apparatus as in claim 2 wherein the switching control unit controls both the polarity and the output level supplied from the battery to the hub motor.

4. Apparatus as in claim 1 wherein the board and its frame are springably supported from the sub-frame.

5. Apparatus as in claim 4 wherein four compression springs at the respective corners of a rectangle allows the board to slant in either or both of two mutually perpendicular directions.

6. Apparatus as in claim 1 which further includes in conjunction with the differentially driven pair of drive wheels a braking mechanism which is adapted to brake a selected one of the wheels.

7. An exercise apparatus for an individual person to achieve dynamic balance exercise by moving their center of gravity, the apparatus comprising, in combination:

(a) an elongated rigid balance board having a generally flat upper surface with a separate foot-supporting area at each end;

(b) a generally rectangular frame arranged in generally parallel relation to the board and having separate compression springs at each of its respective four corners, each spring being in supporting engagement underneath the balance board;

(c) a wheel assembly for supporting the balance board above the ground near its longitudinal center to provide a fulcrum for allowing it to tilt in a longitudinal direction, the wheel assembly including a parallel pair of coaxial wheels on an axle extending laterally to the length of the frame in a supporting relation to respective sides of the frame;

(d) a differential drive mechanism positioned between the two wheels in driving engagement with each of the wheels;

(e) an electric hub motor carried by the frame in engagement with the differential drive mechanism and selectively operable in response to a longitudinal tilting of the board when the person's center of gravity has been moved longitudinally of the board to then drive the wheel assembly along the ground lengthwise of the balance board in generally the same direction that the person's center of gravity has been moved; and (f) a pair of braking members carried on each respective side of the frame for selectively engaging either the front or back of a selected one of the wheels, thus responding to a movement of the person's center of gravity in a direction perpendicular to the length of the board for creating a yawing movement of the board in addition to its longitudinal movement.

8. An exercise apparatus as in claim 7 which further includes a hub motor carried on the axle supporting the wheel assembly, rack gears on the mutually facing inner sides of the wheels, and a pinion gear carried on and driven by the hub motor for applying a differential action through the rack gears to the coaxial wheels.

9. Apparatus as in claim 7 which further includes a battery carried by the balance board for energizing the electric hub motor.

10. Apparatus as in claim 9 which further includes a single wheel supported from the frame on a separate axis, a linkage connected to the single wheel, and which is selectively operable in response to longitudinal movement of the board for controlling energy flow from the battery to the electric hub motor.

11. Apparatus as in claim 10 which includes a Hall Effect transducer controlling the battery operation in response to movement of the single wheel for determining both the voltage of the battery output and the speed of the hub motor operation.

12. A dynamic balance exercise apparatus comprising, in combination:

a balance board;

a parallel pair of coaxial wheels providing a fulcrum for supporting the board;

a differential drive mechanism drivingly engaging the wheels;

an electric motor supported from the board and drivingly coupled to the differential drive mechanism;

a separate brake associated with each wheel; and control means responsive to the angular position of the board for actuating the electric motor and for concurrently actuating a selected one of the brakes.

13. Apparatus as in claim 12 which further includes a frame extending generally parallel to the board, and spring means supporting the board from the sub-frame.

14. Apparatus as in claim 13 wherein the board is elongated, the frame is also elongated, and the pair of wheels are positioned near the longitudinal center of the board.

15. Apparatus as in claim 12 wherein the differential drive mechanism includes a pinion gear, and the electric motor is a hub motor associated with the pinion gear.

16. The method for a person to achieve dynamic balance exercise, comprising the steps of:

selecting a balance board;

placing a parallel pair of wheels underneath the board to provide a fulcrum for supporting the board;

standing on the board in a position which is statically unbalanced both along an axis parallel to the wheels and along an axis perpendicular thereto; and then utilizing an independent source of energy to apply a differential drive action to both wheels while at the same time braking the action of one of the wheels so that the board then moves along a curved path.

17. The method of claim 16 wherein the driving energy independently applied to the wheels is responsive to the imbalance along the axis parallel to the wheels and the braking action is responsive to the imbalance along the axis perpendicular thereto.

18. The method of operating an exercise apparatus, comprising the steps of: supporting a user on an exercise apparatus;

the exercise apparatus comprising a parallel pair of wheels having a common axis of rotation, wherein the wheels include rack gears on mutually facing inner sides;

differentially driving the wheels, wherein a hub motor and a pinion gear provide a differential driving action; and concurrently braking one of the wheels.

* * * * *